US007670100B2

(12) United States Patent
Hannen et al.

(10) Patent No.: US 7,670,100 B2
(45) Date of Patent: Mar. 2, 2010

(54) ALIGNING A STACK ON A PALLET OR THE LIKE

(75) Inventors: Reiner Hannen, Kalkar-Wissel (DE); Norbert Vermeulen, Kleve-Warbeyen (DE)

(73) Assignee: MSK-Verpackungs-Systeme Gesellschaft MIT Beschrankter Haftung, Kleve (DE)

( * ) Notice: Subject to any disclaimer, the term of this patent is extended or adjusted under 35 U.S.C. 154(b) by 50 days.

(21) Appl. No.: 10/552,431

(22) PCT Filed: Feb. 17, 2005

(86) PCT No.: PCT/EP2005/001630

§ 371 (c)(1),
(2), (4) Date: Oct. 5, 2005

(87) PCT Pub. No.: WO2005/080243

PCT Pub. Date: Sep. 1, 2005

(65) Prior Publication Data

US 2006/0280590 A1 Dec. 14, 2006

(30) Foreign Application Priority Data

Feb. 17, 2004 (DE) ..... 20 2004 002 488 U
Feb. 17, 2004 (DE) ..... 20 2004 003 136 U

(51) Int. Cl.
*B65G 57/00* (2006.01)

(52) U.S. Cl. ..... 414/789.1; 414/788.9; 271/222; 271/224

(58) Field of Classification Search ..... 414/788.9, 414/789.1, 789.9, 790.2, 795.7, 907; 271/224, 271/223, 210, 222; 403/40, 179, 204, 266, 403/269, 270, 271; 267/112; 464/149; 100/3; 294/67.31, 67.33
See application file for complete search history.

(56) References Cited

U.S. PATENT DOCUMENTS

| | | | | | |
|---|---|---|---|---|---|
| 233,483 | A * | 10/1880 | Dietz | 285/330 |
| 1,773,068 | A * | 8/1930 | Vienneau | 219/105 |
| 2,198,652 | A * | 4/1940 | Cullen et al. | 294/67.33 |
| 2,602,554 | A * | 7/1952 | Griffith | 198/434 |
| 2,761,682 | A * | 9/1956 | Buccicone | 271/224 |
| 3,557,413 | A * | 1/1971 | Engle | 24/584.1 |
| 3,902,214 | A * | 9/1975 | Schmitt | 15/93.4 |
| 3,980,312 | A * | 9/1976 | Buttner | 280/610 |
| 4,154,330 | A * | 5/1979 | Lucas | 198/411 |
| 4,400,124 | A * | 8/1983 | Greller | 414/790.2 |
| 4,466,606 | A * | 8/1984 | Snellman et al. | 271/221 |
| 4,508,333 | A * | 4/1985 | Byrt | 271/218 |
| 4,927,321 | A * | 5/1990 | Lucas | 414/788.9 |
| 5,292,223 | A * | 3/1994 | Meschi | 414/788 |
| 5,944,477 | A * | 8/1999 | Shill | 414/788 |
| 6,073,926 | A * | 6/2000 | Kaneda et al. | 271/221 |
| 6,209,865 | B1 * | 4/2001 | Regimbal et al. | 271/220 |
| 6,231,299 | B1 * | 5/2001 | Newsome et al. | 414/788.9 |

(Continued)

*Primary Examiner*—Gregory W Adams
(74) *Attorney, Agent, or Firm*—Berenato & White, LLC

(57) ABSTRACT

In a stack of flexible sheets on a substrate having an outer edge, some of the sheets project laterally past one of the edges. The stack is tamped together by a stabilizing element shiftable horizontally toward and away from the one edge of the substrate and a drive that shifts the stabilizing element horizontally toward the stack and substrate for engaging the projecting sheets and pushing same inward on substrate to a position lying on or inward of the outer edge without vertically bending or deflecting the sheets.

11 Claims, 4 Drawing Sheets

U.S. PATENT DOCUMENTS 6,290,452 B1 * 9/2001 Wachter ..... 414/788.1
6,386,824 B1 * 5/2002 Pizzi et al. ..... 414/793.4
6,494,450 B2 * 12/2002 Tsurumaki ..... 271/224

* cited by examiner

ALIGNING A STACK ON A PALLET OR THE LIKE

CROSS REFERENCE TO RELATED APPLICATIONS

This application is the US national phase of PCT application PCT/EP2005/001630, filed 17 Feb. 2005, published 1 Sep. 2005 as WO 2005/080243, and claiming the priority of German patent application 202004003136.1 itself filed 17 Feb. 2004 and German patent application 202004002488.8 itself filed 17 Feb. 2004, whose entire disclosures are herewith incorporated by reference.

FIELD OF THE INVENTION

The invention relates to an apparatus for aligning an item that can be deformed easily, at least in the region of its outer lower edge, such as a stack of items comprising in particular flat structures made of a flexible material, such as sheets of paper or the like, on a transport substrate, such as a pallet, at least one aligning device that can be displaced in the direction of the item stack and the transport substrate being provided to align the item stack on the transport substrate.

BACKGROUND OF THE INVENTION

Apparatuses of this type are used in practice in order, for example, to align the item stack relative to the transport substrate before the packaging operation and after the loading operation.

Alignment is necessary in order that the item stack is oriented within the footprint of the transport substrate since regions of the item stack projecting beyond the footprint can be damaged during subsequent transport, for example by adjacent pallets.

Known aligning devices comprise two continuous displaceable walls that confront each other horizontally or vertically and that in each case are moved in parallel or together toward the item stack and in this way the item stack is aligned relative to the transport substrate.

The alignment of flat structures in particular, such as stacks of paper sheets, proves to be problematical. For example, when paper is being cut to size, cross-cutters are used, as a result of which the paper stack may not be positioned centrally on the transport substrate but instead may project by up to 40 mm on the longitudinal side and/or the transverse side of the transport substrate. Since paper can be damaged very easily in the region of such a projecting portion during transport, alignment is required, in particular under all circumstances in the case of stacks of paper.

Previously known mechanical devices cannot be used since, during alignment with these devices, the lower edges are bent downward as a result of the force of the alignment device and can be clamped between the transport substrate and the aligning device. Apart from the fact that the bent-down sheets can no longer be used, the bent-down sheets also prevent further displacement, so that satisfactory alignment is not possible. Given a lack of technical solutions, the stacks of paper are therefore aligned by hand. Here, in the region of the projecting portion, the transport substrate is moved into the desired position by means of specific blows.

OBJECTS OF THE INVENTION

It is therefore an object of the invention to improve a known apparatus in such a way that an item stack projecting laterally beyond the outer footprint of a transport substrate can be moved mechanically into the footprint of the transport substrate and damage to the item stack during alignment can be avoided.

Another objects of the invention is to provide an improved method of aligning an item stack on a substrate, for example a stack of paper sheets on a pallet.

SUMMARY OF THE INVENTION

This object is achieved in that at least the portion of at least one aligning device that comes into contact with the lower region of the item projecting laterally beyond the outer footprint of the transport substrate during the alignment of the item stack on the transport substrate is provided with a stabilizing device that prevents the item stack from being deflected toward the transport substrate.

During displacement of the item stack, if the latter is formed as a stack of paper, the stabilizing device in particular prevents the lower sheets from bending over downward and being turned under, and in this way the item stack can be pushed at least sufficiently far that it terminates flush with the footprint of the transport substrate. The aligning device can be formed, for example, as a displaceable wall. However, it is also entirely possible for appropriate displaceable walls to be provided on two opposite sides, between which the item stack is aligned.

The stabilizing device can include a layer that inhibits slipping. In this way, friction between the aligning device and the item stack is increased, so that slippage of the item stack, in particular when this is a stack of paper, where the edge is in contact with the aligning device is prevented.

It is recommended that the stabilizing device includes a resilient element. This has the effect that, during displacement, the resilient element bears from below on the lower edge of the item stack and in the process exerts a supporting force on the item stack such that bending over or turning under of the lower region of the item stack is prevented.

The element can be made of rubber, for example, such as foam rubber or cellular rubber.

Other embodiments of a stabilizing device are possible. For example, the stabilizing device can comprise a supporting device for supporting the item stack. This can be, for example, an angle integrally molded on the aligning device and that can be used when transport substrates of a defined height are employed. This angle supports the item stack on the underside.

In another embodiment, the stabilizing device can have a supporting surface adjoining the contact surface of the transport substrate laterally at a short distance, at least during the alignment, and at least approximately aligned with the contact surface. This supporting surface can be moved into its operating position, for example by moving toward the transport substrate or by pivoting. The height of the supporting surfaces can preferably be varied, so that transport substrates of different heights can also be employed. In the operating position of the supporting surface, the aligning device which for example is formed as a displaceable wall, is moved through a short distance along the upper side of the supporting surface so that when the aligning device is displaced toward the item stack, the item stack is displaced and the lower flat structures of the item stack are protected by the supporting surfaces from being bent under.

The aligning devices can be formed in one piece. However, it is also entirely possible for the aligning devices to be formed of several parts, at least in an upper and a lower segment, relative to the height of the item stack, and the stabilizing device can be provided at least on the lower segment.

In this case, it is recommended that the adjacent edges have mutually at least approximately complementarily curved edges with projecting and set-back portions, in particular in the shape of interengaging waves. If the aligning device is formed in two parts, it is recommended that the stabilizing device, if it includes a resilient element, be provided at least in the lower region. In this case, it is recommended for the upper region to be capable of being moved further inward toward the item stack at least by the thickness of the resilient element in the compressed state, in order to prevent the formation of an edge offset in the region of the item stack.

The height of at least one aligning device is matched to the upper edge of the transport substrate in such a way that movement beyond the edge of the transport substrate is possible. This makes it possible for the item stack to be displaceable beyond the edge on the transport substrate.

The invention also relates to a method for aligning an items that can be deformed easily, at least in the region of the outer lower edge, such as a stack of items comprising in particular flat structures made of a flexible material, such as paper sheets or the like, on a transport substrate, such as a pallet, at least one aligning device that can be displaced toward the item stack and the transport substrate being provided to align the item stack on the transport substrate.

Alignment methods are carried out in practice in order, for example, to align the item stack relative to the transport substrate before the packaging operation and after the loading operation.

Alignment is necessary in order that the item stack is positioned within the footprint of the transport substrate since regions of the item stack projecting beyond the footprint can be damaged during subsequent transport, for example by adjacent pallets.

In known alignment methods, aligning devices are used that comprise two continuous displaceable walls that confront to each other horizontally or vertically and that in each case are moved in parallel or together toward the item stack and in this way the item stack is aligned relative to the transport substrate.

According to the method of the invention downward deflection of the lower region of the item projecting laterally beyond the footprint of the transport substrate is prevented by a stabilizing device that is provided with at least the portion of the aligning device that comes into contact with the region of the item projecting laterally beyond the footprint of the transport substrate during alignment of the item stack on the transport substrate. During displacement of the item stack, if the latter is formed as a stack of paper sheets, the use of the stabilizing device in particular prevents the lower sheets bending over downward and being turned under. In this way the item stack can be pushed at least sufficiently far that it terminates flush with the footprint of the transport substrate. The aligning device(s) can be formed, for example, as a displaceable wall. However, it is also entirely possible for appropriate displaceable walls to be provided on two opposite sides, between which the item is aligned.

Thus before alignment of the item stack on the transport substrate, the transport substrate can for its part be aligned relative to at least one aligning device. For this purpose, use can be made for example of abutments that are preferably arranged transversely with respect to the travel direction and are moved against the transport substrate. As a result, the transport substrate is aligned parallel with the travel direction.

A thin sheet can be laid on the transport substrate as a layer before the loading of the transport substrate with the item stack. In another embodiment, a film, in particular an oil film, can be applied to the underside of the item stack as a layer.

BRIEF DESCRIPTION OF THE DRAWING

In the following text, an illustrated embodiment of the invention illustrated in the drawings will be explained. In the drawings.

SPECIFIC DESCRIPTION

In all the figures, the same designations are used for the same or identical components.

Figure 1:
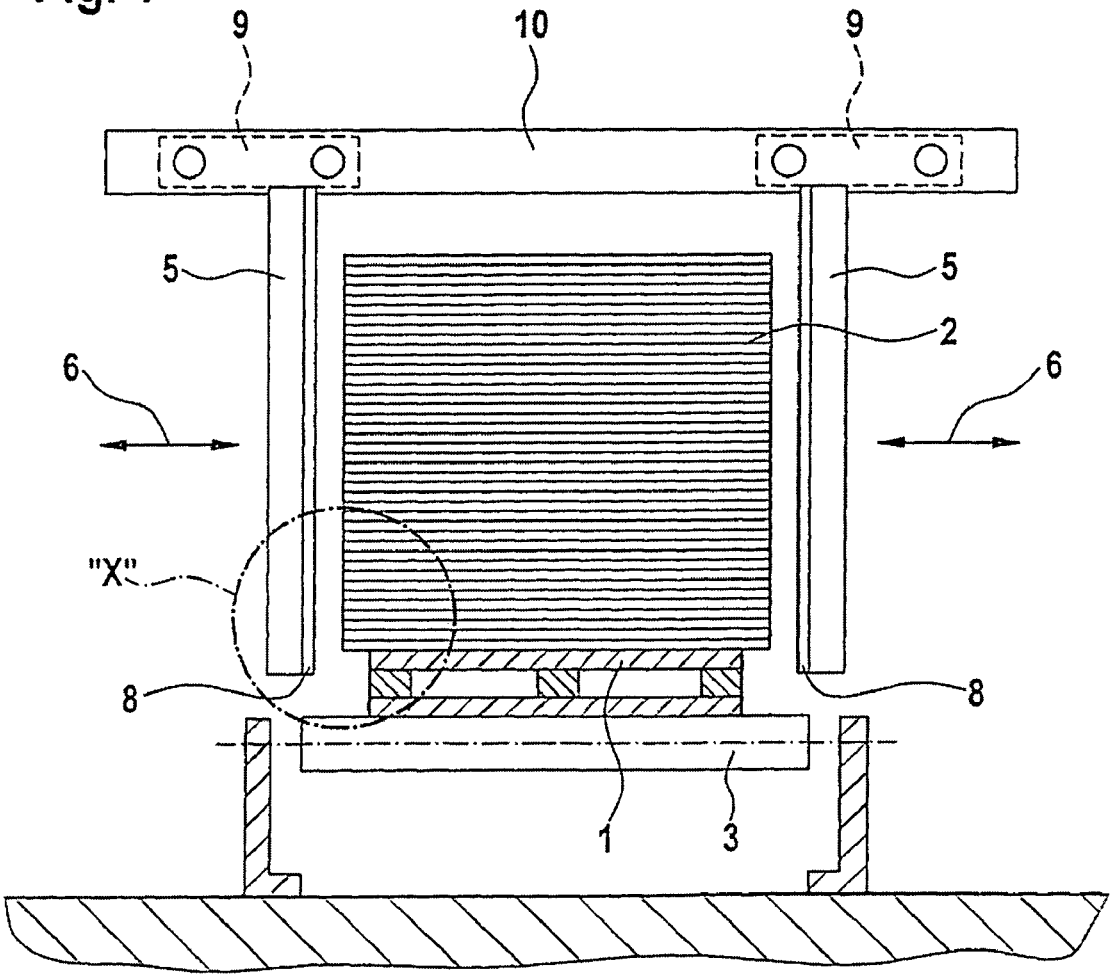
FIG. 1 is a side view of an apparatus according to the invention.
Figure 2:
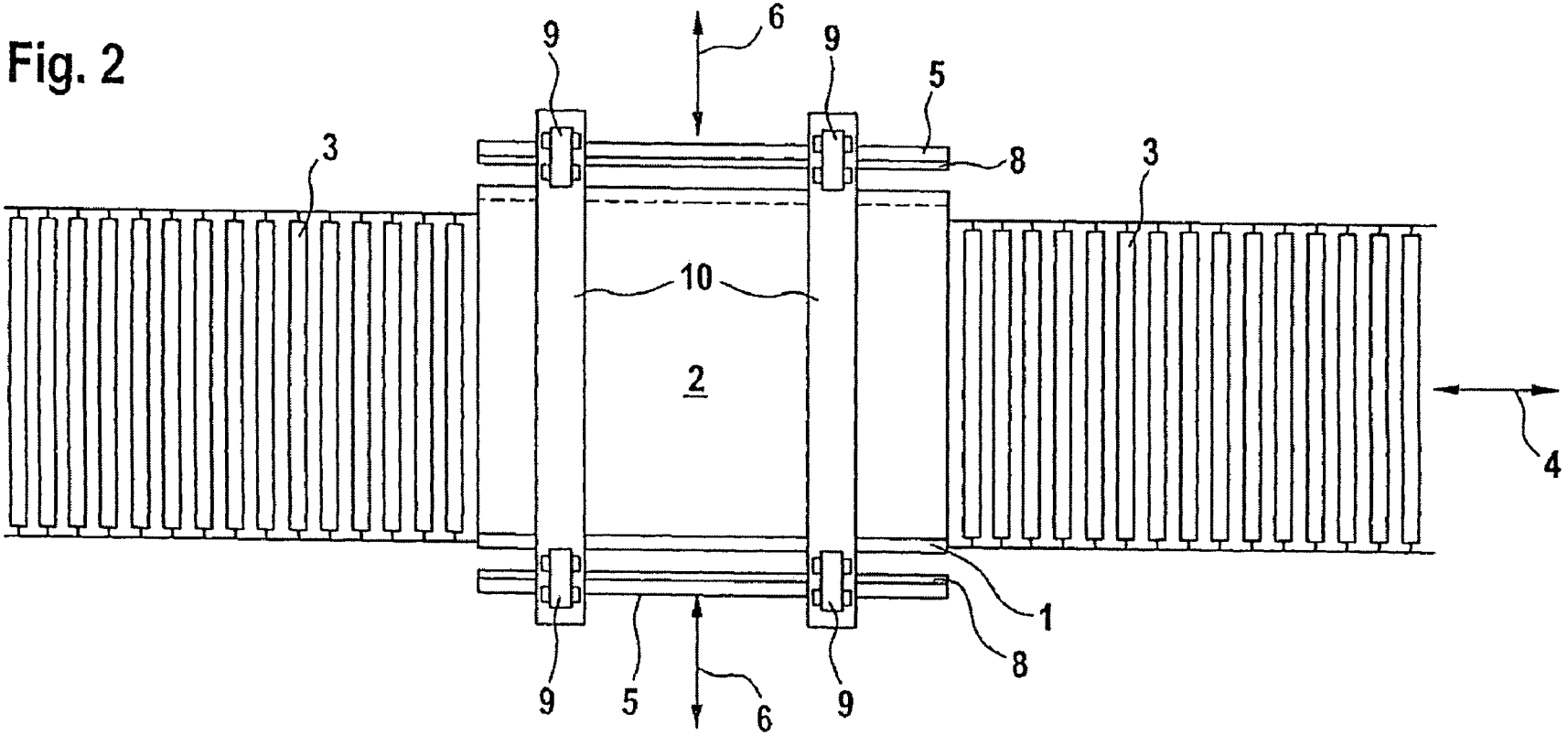
FIG. 2 is a plan view of the subject according to FIG. 1.

In FIGS. 1 and 2, a transport substrate 1 formed as a pallet is illustrated carrying a stack of items. Each item of the stack 2 has previously been placed on the transport substrate 1 by an unillustrated loading device upstream of the aligning operation. The items are flat, such as sheets of paper that are stacked on one another and, in the illustrated embodiment, project beyond the transport substrate 1 on the left-hand side.

On the underside, the transport substrate 1 rests on a roller conveyor 3. By means of this roller conveyor 3, the transport substrate 1 with the item stack 2 located on it is, for example, moved from a loading device to the apparatus according to the invention, the transport substrate 1 having been previously aligned with respect to the roller conveyor 3 in order that the transport substrate 1 is aligned parallel to the travel direction 4. For this purpose, for example, abutments arranged transversely with respect to the travel direction 4 and against which the transport substrate 1 is moved can be provided in the roller conveyor 3.

In order to align the item stack 2, the apparatus, as illustrated in FIGS. 1 and 2, has an aligning device 5 on both sides of the roller conveyor 3, each aligning device 5 being formed as a displaceable wall aligned parallel with the travel direction 4. The aligning devices 5 can be moved toward the item stack 2 in the direction of the arrows 6. They can be driven individually or together.

Figure 3:
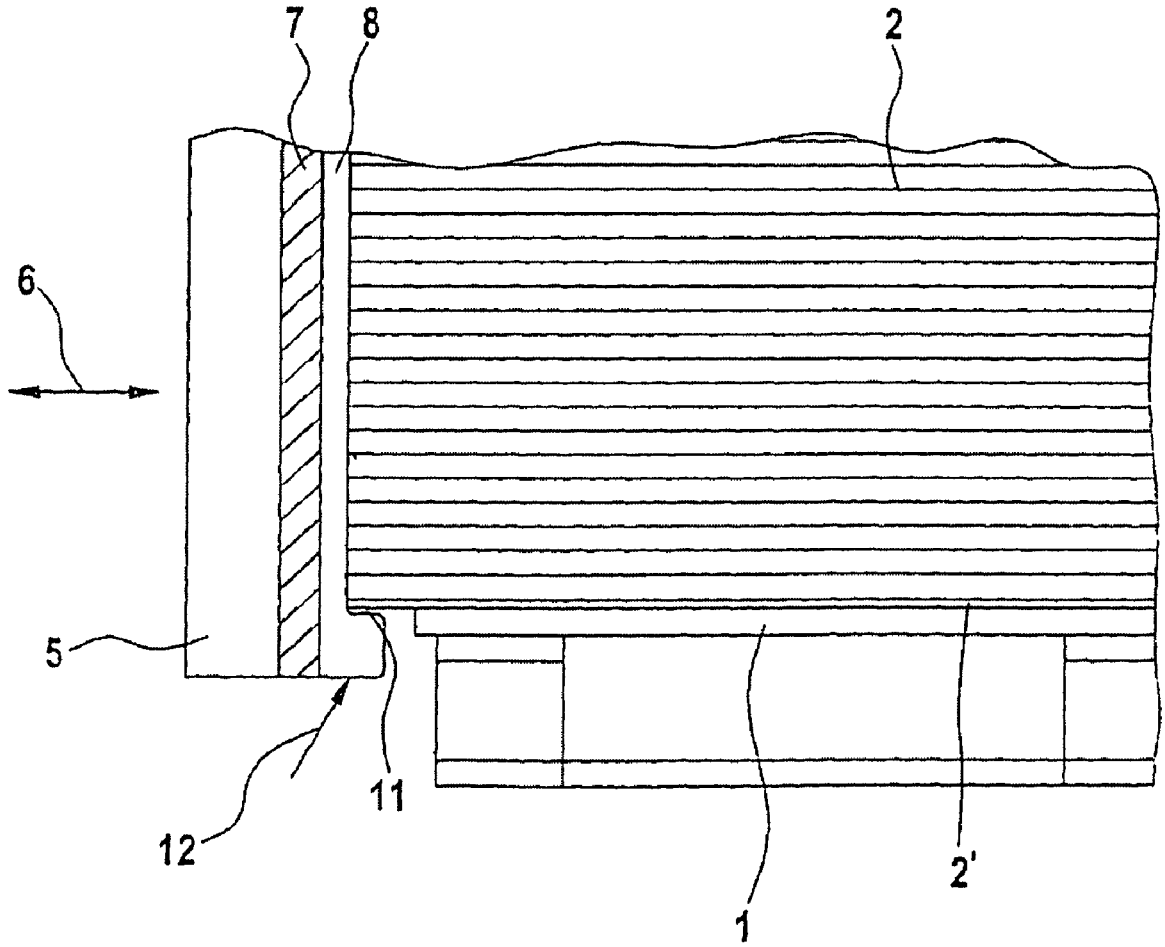
FIG. 3 is the detail "X" from FIG. 1.

In the embodiment illustrated in FIG. 3, a wooden board 7 is provided on the side of the aligning device 5 facing the item stack 2. On the side of the wooden board 7 itself facing the item stack 2 there is in turn fitted a stabilizing device 8 that, in the illustrated embodiment illustrated, includes a resilient element.

The aligning devices 5 are held in a supporting construction 10 by roller arrangements 9. During alignment, first of all the left-hand aligning device 5 illustrated in FIG. 1 meets the item stack 2. In the process, the resilient material is compressed, the resilient material bearing on the lower edge 11 of the item stack 2 and applying a force in the direction of the arrow 12 and in this way preventing the lower paper layers from bending or turning over. During further displacement in the direction of the transverse arrow 6, each stabilizing device 8 comes into contact with the transport substrate 1 with its lower end that projects downward beyond the item stack 2. Because of the resilience of the stabilizing device 8, however, the displacement movement can be continued until the outer edge of the item stack 2 is flush with the outer edge of the transport substrate 1.

For the case in which alignment and thus movement of the item stack 2 inward beyond the footprint of the transport substrate 1 is desired, the aligning devices 5 have to be matched to the height of the transport substrate 1 in such a way that the aligning devices 5 in the lower region can move inward over the upper edge of the transport substrate 1.

The resilient material used can be, for example, a foam rubber or a closed-cell, resilient cellular rubber having cell sizes of 0.2 to 0.5 mm. In this case, the surface of the material coming into contact with the item stack 2 is preferably closed, so that air escaping during compression must necessarily emerge via the side edges whose areas are smaller.

In the embodiment illustrated in FIGS. 1 and 2, the item stack 2 is aligned at the longitudinal edges. If alignment at the shorter transverse edges is desired, aligning devices 5 must likewise be provided in these regions. In the rest position, the aligning devices 5 are located completely out of the active range of the roller conveyor 3. For alignment, the aligning devices 5 are moved orthogonally with respect to the travel direction 4 until in the desired position.

Figure 4:
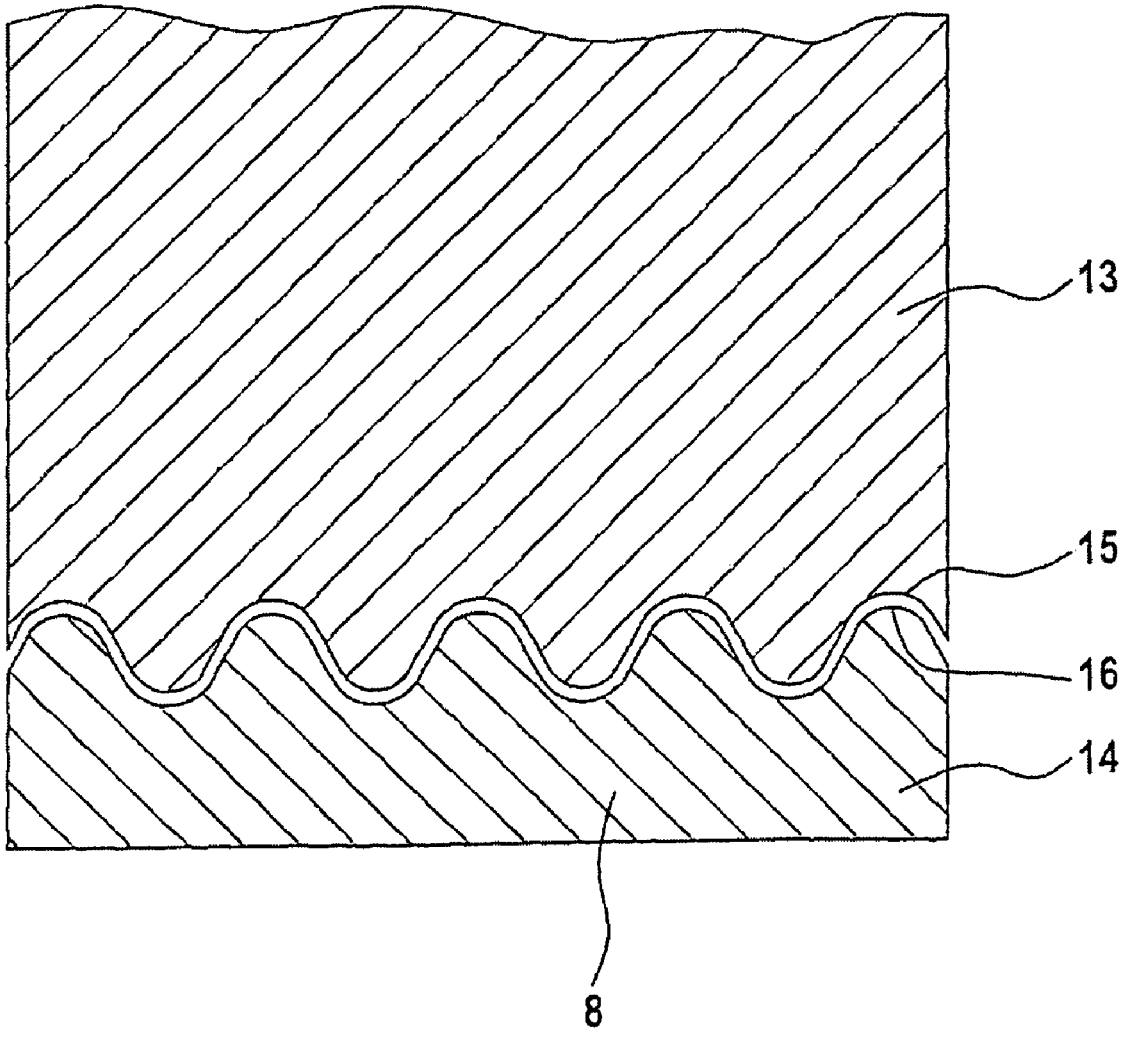
FIG. 4 is a section through part of a multi-part aligning device.

In FIGS. 1 to 3, the aligning devices 5 are formed in one piece. FIG. 4 shows a divided aligning device 5 that is divided into an upper and lower segments 13 and 14. In this case, the adjacent edges 15 and 16 have mutually at least approximately complementary edge curves with projecting and setback portions. In the illustrated embodiment illustrated, the edges 15 and 16 are formed in the shape of waves. The stabilizing device 8 including the resilient element is in this case the lower segment 14.

The upper segment 13 is preferably moved further toward the item stack 2 by the thickness of the stabilizing device 8 in the compressed state. In conjunction with the interengaging edge curves, an offset inward of the side edge of the item stack 2 can thus be avoided.

In order to reduce friction between the item stack 2 and the transport substrate 1, as shown in FIG. 3 a friction-reducing layer 2' can be provided. This layer 2' can be a thin layer of oil or a low-friction foil between the transport substrate 1 and the lowest paper underlayer.

The provision of a thin sheet proves to be advantageous in that a thin sheet cover subsequently drawn over the item stack 2 following the alignment can be welded to the thin sheet and in this way the item stack 2 is protected against moisture.

The invention claimed is:

1. An apparatus for aligning an entire stack of flexible sheets resting on a transport substrate, with said transport substrate, wherein an outer lower edge portion of said entire stack is projecting laterally past at least one edge of said transport substrate, the apparatus comprising:

an aligning element shiftable horizontally toward and away from the one edge of the transport substrate and having a face of said aligning element directed toward the stack and including a slip-preventing layer on the face of said aligning element in a region corresponding to said outer lower edge of said stack; wherein the aligning element further comprises a pair of aligning elements wherein each said aligning element has a vertically oriented face and a horizontal surface portion adjacent the face and generally level with an upper surface of the transport substrate; wherein when the aligning element is shifted horizontally toward the stack and substrate edge, said slip preventing layer engages and supports the projecting outer lower edge portion of the stack and pushes the entire stack inward on the transport substrate thereby altering the alignment of said entire stack with respect to said transport substrate without downwardly bending or deflecting the flexible sheets that form said outer lower edge of said entire stack.

2. The apparatus defined in claim 1 wherein the slip preventing layer is resilient.

3. The apparatus defined in claim 2 wherein the slip preventing layer is made of an elastomer.

4. The apparatus defined in claim 1 wherein the aligning element has an upper and a lower part.

5. The apparatus defined in claim 4 wherein the upper and lower part are joined together at a nonplanar interface.

6. An apparatus for aligning an entire stack of flexible sheets resting on a transport substrate with respect to said transport substrate, said entire stack having an outer lower edge portion projecting laterally past at least one of the edges of said transport substrate, the apparatus comprising:

an aligning element shiftable horizontally toward and away from the one edge of the transport substrate, said aligning element including a member on a face of said aligning element directed toward said transport substrate, said member being engageable under the stack; wherein the aligning element further comprises a pair of aligning elements wherein each said aligning element has a vertically oriented face and a horizontal surface portion adjacent the face and generally level with an upper surface of the transport substrate; wherein when the aligning element is shifted horizontally toward the stack the member engages and fits under the projecting portion of said stack to support same while pushing the entire stack of flexible sheets inward on the transport substrate to a newly aligned position on said transport substrate without downwardly bending or deflecting the flexible sheets that form the projecting portion of said stack.

7. A method of aligning an entire stack of flexible sheets lying on a transport substrate having an outer edge, wherein a lowermost outer edge portion of the stack is projecting laterally past one of the edges of said transport substrate, the method using an aligning element, and comprising the steps of:

providing a pair of aligning elements wherein each said aligning element has a vertically oriented face and a horizontal surface portion adjacent the face and generally level with an upper surface of the transport substrate;

pressing a nonslip surface of said aligning element against the laterally projecting lowermost outer edge portion of said entire stack of flexible sheets;

engaging and supporting said lowermost outer edge portion of said stack with said nonslip surface and preventing deflection of said lowermost edge, and shifting said entire stack with respect to said transport substrate by movement of said aligning element without downward bending of the flexible sheets occurring.

8. The method defined in claim 7, further comprising a step preceding the pressing step, wherein:

aligning said transport substrate relative to the aligning element occurs.

9. The method defined in claim 7, further comprising the step of reducing friction between a lowermost sheet of the stack and a support surface of the transport substrate on which it rests.

10. The method defined in claim 9 wherein friction is reduced by providing a low-friction layer between the lowermost sheet and the upper surface.

11. A method defined in claim 9 wherein friction is reduced by coating the upper surface with a lubricant.

* * * * *